United States Patent [19]

Mazaki

[11] Patent Number: 4,708,410

[45] Date of Patent: Nov. 24, 1987

[54] DOOR DEVICE FOR FURNITURE

[75] Inventor: Yoshiyuki Mazaki, Kokubunji, Japan

[73] Assignee: Kabushiki Kaisha Murakoshi Seiko, Tokyo, Japan

[21] Appl. No.: 904,662

[22] Filed: Sep. 8, 1986

[30] Foreign Application Priority Data

Sep. 12, 1985 [JP] Japan ..... 60-202446

[51] Int. Cl.[4] ..... A47F 3/00

[52] U.S. Cl. ..... 312/138 R; 49/127; 49/130

[58] Field of Search ..... 49/127, 130; 160/194, 160/211; 312/324, 138, 350, 308

[56] References Cited

U.S. PATENT DOCUMENTS 3,064,723 11/1962 Paillard et al. ..... 49/127 X 3,120,034 2/1964 Pauwels ..... 49/127

4,384,429 5/1983 Rokicki et al. ..... 49/130

*Primary Examiner*—Joseph Falk

*Attorney, Agent, or Firm*—James E. Nilles

[57] ABSTRACT

A door device for furniture, which has a plurality of door members provided laterally in opposition to each other in a front opening of a furniture body, longitudinal sliders capable of moving the door members in the longitudinal direction with respect to the furniture body, and a lateral slider capable of moving the door members in the lateral direction with respect to the furniture body, the front opening being opened by sliding one of the door members forward and then sideways to superpose the door member on the front surface of the adjacent door member, a plurality of support rails fixed to the portions of the furniture body which correspond to the door members, and a support roller which is adapted to engage a support rail on the side of the door member adjacent to the door member to be opened, when the lateral slider is extended to more than a predetermined extent during the lateral sliding of the door member to be opened to cause the lateral slider to be inclined slightly due to the load of the same door member, provided on the lateral movable rail so that the support rollers can be rotated freely.

5 Claims, 7 Drawing Figures

DOOR DEVICE FOR FURNITURE

BACKGROUND OF THE INVENTION

1. Field of the Invention:

This invention relates to a door device for furniture, and more particularly to a door device for furniture, which consists of at least a pair of door members provided laterally in opposition to each other in a front opening of a furniture body, and which is designed so that one of the door members is pulled out forward and then slid sideways to be superposed over the front surface of the other door member, whereby the front opening of the furniture body is opened.

2. Description of the Prior Art:

A door device for furniture, which is adapted to be slid forward and then sideways to open the front side of a furniture body as mentioned above, has recently been used. In a conventional door device of this kind for furniture, longitudinally-extending movable rails, with which a door member is engaged, are supported on longitudinally-extending fixed rails set in, for example, a furniture body, in such a manner that the former rails can be slid longitudinally, whereby a mechanism for use in sliding the door member in the longitudinal direction is formed. This door device is further provided with rollers having grooves in their circumferential surfaces and arranged at the lower end of the front side of the door member, and a guide rail which has a projection with which the grooves in the rollers are engaged slidably when the door member is pulled out forward, and which is provided at the front side of the lower portion of the furniture body so that the guide rail extends laterally, providing a lateral slide mechanism for both supporting the door member and preventing the door member from being moved loosely in the longitudinal direction.

In this conventional construction, when the door member is pulled out forward, the grooves in the rollers on the door member are engaged with the projection on the guide rail, and the door member is slid laterally along the projection. Therefore, it is necessary that the guide rail be formed with a high dimensional accuracy, and that the door member has an accurate quantity of longitudinal sliding movement. Accordingly, in the steps of manufacturing this door device, the production and assembling of the parts thereof must be carried out with a high accuracy. This makes it difficult to assemble the door device. Moreover, there is the possibility that the grooves in the rollers and the projection on the guide rail are not engaged reliably to spoil a smooth movement of the door member during the practical use of the door device.

A furniture door device of this kind generally has a large number of movable parts as mentioned above. Hence, when a door member is slid, it is apt to shake. Especially, when the door member is slid forward or backward, a difference occurs between the quantities of movements of the left and right portions thereof or the quantities of movements of the upper and lower portions thereof. Consequently, the door member is inclined easily in the lateral or longitudinal direction, i.e., the movement of the door member tends to become unstable.

SUMMARY OF THE INVENTION

An object of the present invention is to provide a door device for furniture, which has longitudinal sliders adapted to move door members freely in the longitudinal direction and provided with longitudinal fixed rails; and a lateral slider adapted to move the door members freely in the lateral direction, and provided with a plurality of lateral fixed rails held on the longitudinal fixed rails, and a plurality of lateral movable rails supported slidably on the lateral fixed rails, wherein the foremost lateral movable rail supports the door members thereon fixedly, and which does not thereby require highly accurate quantities of, especially, the longitudinal sliding movements of the door members, whereby the relaxing of the restrictions on the allowable dimensional errors of each part of the door device, the improving of the efficiency in assembling these parts and the securing of smooth movements of the door members can be done reliably.

Another object of the present invention is to provide a door device for furniture, which has support rollers provided on left and right movable rails and adapted to be moved slidingly on a support rail fixed to a furniture body, which support rollers lessen the load on a lateral slider and smooth the movements of door members, the support rollers bringing the lateral slider into contact with a support rail on the side of the door members with the lateral slider extended to a length more than a predetermined level, to thereby enable the practical use of a support rail of a length substantially equal to the width of each door member, and the formation of joint portions of the support rails for the respective door members with a comparatively low accuracy, whereby the door device can be manufactured more easily.

Still another object of the present invention is to provide a door device for furniture, which has guide rollers at both end portions of lateral movable rails, and longitudinal and lateral guide rails on a furniture body and door members, the guide rollers being moved slidingly along the longitudinal guide rails when a door member is slid in the longitudinal direction, to thereby prevent the door member from shaking laterally, the guide rollers being moved slidingly along the lateral rail when a door member is slid laterally, to thereby prevent the door member from shaking longitudinally, the same guide rollers that prevent the lateral shaking of a door member thus being employed for preventing the longitudinal shaking of the door member to thereby enable the reduction of the number of parts of the door device and simplification of the device.

A further object of the present invention is to provide a door device for furniture, which has guide plates fixed to longitudinally movable rails in longitudinal sliders arranged opposite to each other on both sides of a door member, recesses provided in the guide plates, a pair of arm members the locking shafts of which are engaged with these recesses so that the locking shafts can be turned and vertically moved, and a shaft joined to these arm members and supported fixedly on a furniture body so that the shaft can be turned forward and backward, the arm members being turned with the shaft when the door member is moved longitudinally, to synchronize the movements of both side portions of the door member and thereby prevent the door member from being inclined, especially, in the lateral direction, whereby the movement of the door member can be stabilized.

A further object of the present invention is to provide a door device for furniture, which has a lower arm member an end portion of which is engaged pivotably with a longitudinally movable rail, a shaft fixed to a base portion of the lower arm member and adapted to be turned with the lower arm member when a door member is moved longitudinally, an upper arm member that has a base portion is which is fixed to the shaft and adapted to be turned with the lower arm member and shaft, and a longitudinally movable plate which is engaged with the end portion of the upper arm member so that the upper arm member can be turned, and which is supported on a furniture body so that the longitudinally movable member can be moved in the longitudinally direction, this longitudinal movable membe being moved with the lower arm member, shaft and upper arm member to synchronize the movements of the upper and lower portions of the door member with each other, and thereby prevent the door member from inclining in the longitudinal direction, whereby the movement of the door member can be stabilized.

Other objects and characteristics of the present invention will be described with reference to the drawings.

DESCRIPTION OF THE PREFERRED EMBODIMENT

Figure 7:
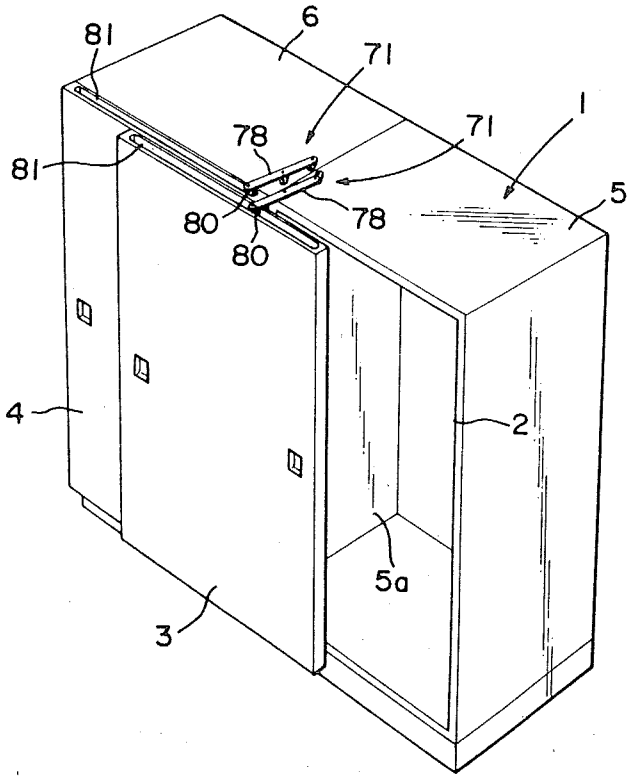
FIG. 7 is a perspective view of the furniture with a door member thereof opened.
Figure 6:
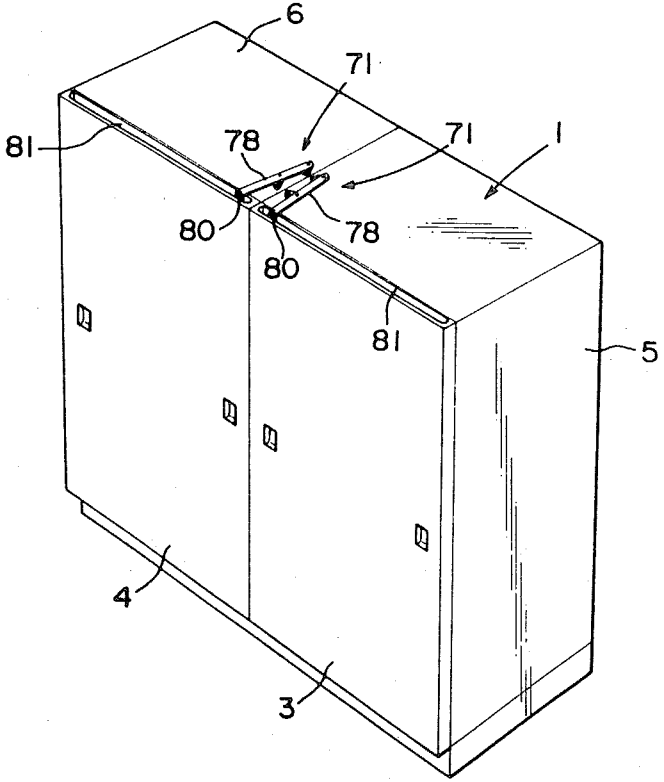
FIG. 6 is a perspective view of a piece of furniture.

A door device for furniture in this embodiment is used to open and close a front opening 2 of a furniture body 1 as shown in FIGS. 6 and 7, and has a pair of door members 3, 4 arranged in a laterally opposed relationship in this opening 2. As shown in FIG. 7, for example, one door member 3 is slid forward and then sideways so as to be superposed over the front surface of the other door member 4, whereby the opening 2 is uncovered. The furniture body 1 is formed by joining to each other a pair of furniture body members 5, 6 each in the shape of a rectangular box substantially identical to the other. The door members 3, 4 are formed so that the front openings 2 of the furniture body members 5, 6 are opened and closed by the door members.

The door device for furniture in this embodiment is made symmetrical with respect to the joint surfaces of the furniture body members 5, 6, and these furniture body members 5, 6 are independent of each other. Therefore, the parts of one furniture body member 5 will now be described. The parts of the other furniture body member 6 which appear in the drawings are represented by the same reference numerals by which the corresponding parts of the furniture body member 5 are designated. The words "left" and "right", which will be used to express the positional relation between the parts of this embodiment, shall be based on a front elevation of the furniture body 1.

Figure 1:
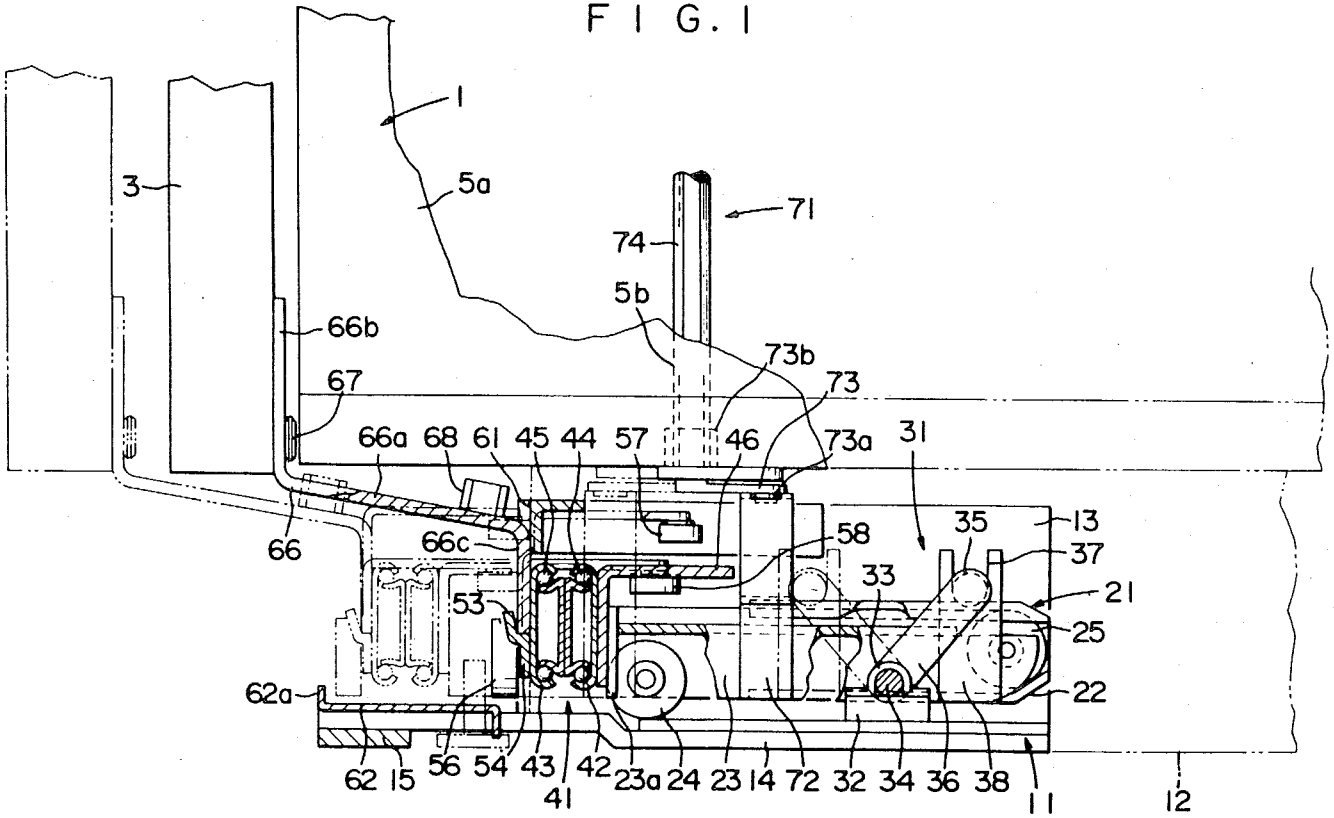
FIG. 1 is a partially cutaway view in side elevation of an embodiment of the door device for furniture according to the present invention.
Figure 2:
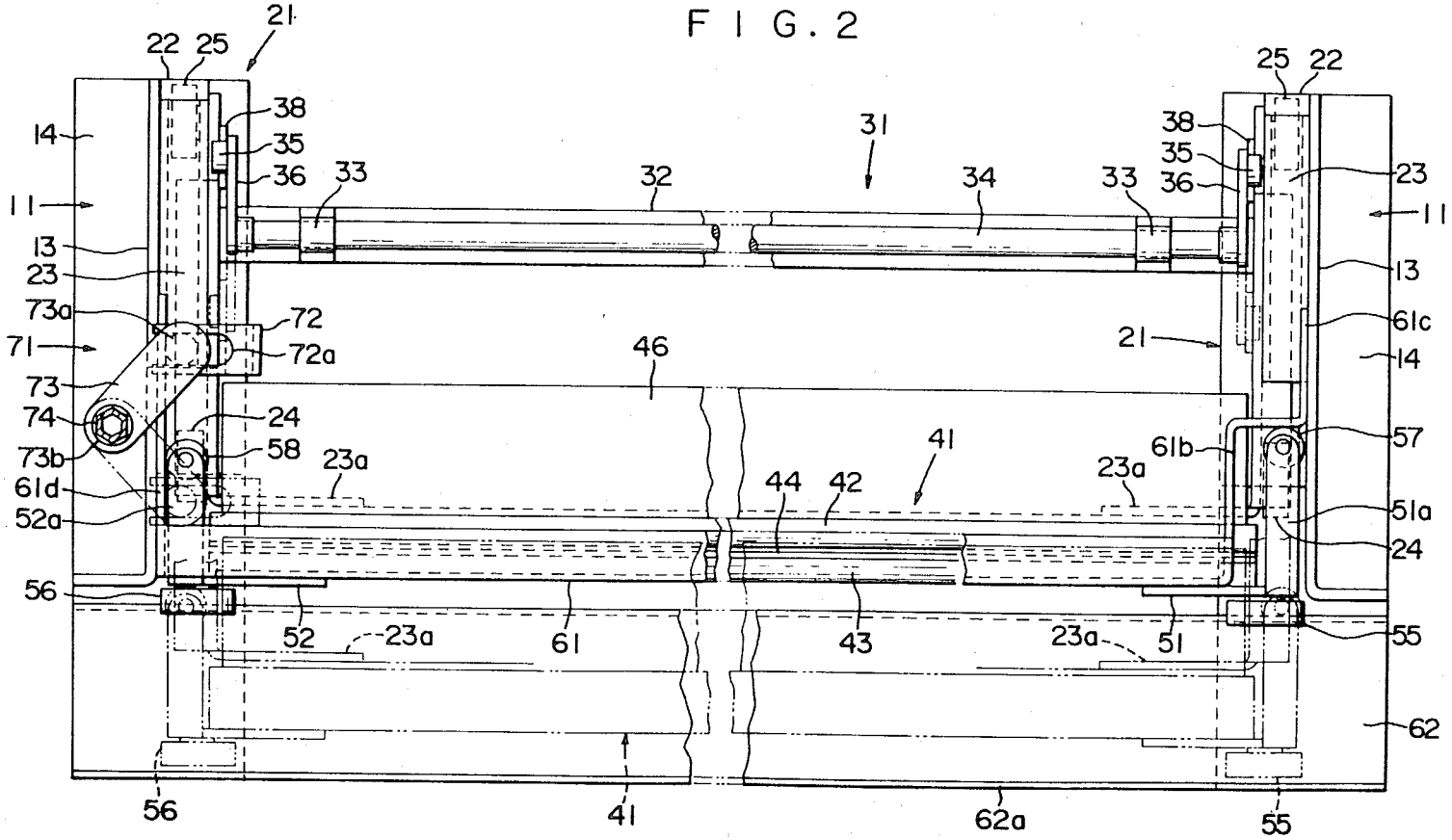
FIG. 2 is a partially cutaway view in plan of the embodiment.
Figure 3:
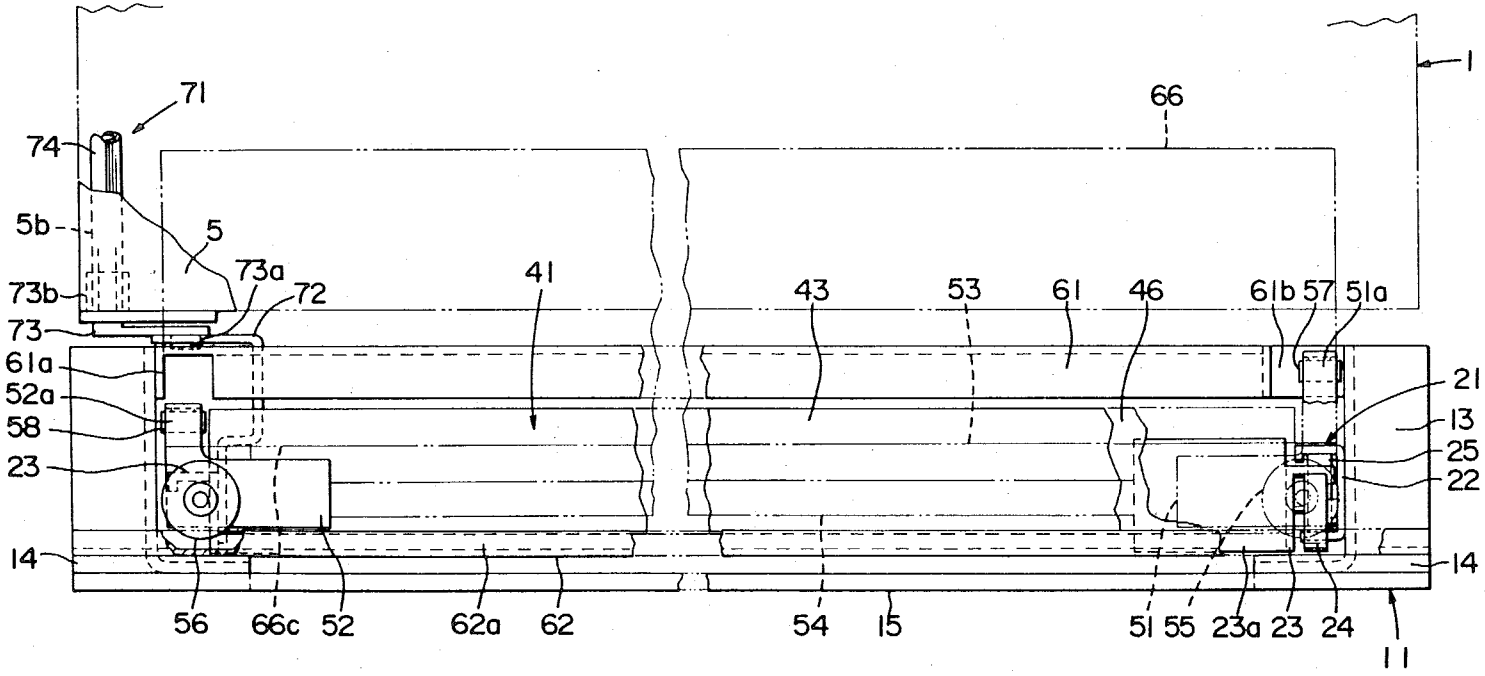
FIG. 3 is a partially cutaway view in front elevation of the embodiment.

Referring to FIG. 1, reference numeral 11 denotes frames consisting of longitudinal holder plates 13 serving also as guide rails and vertically fixed to the front portions of screen plates 12 which are provided vertically at both side edge portions of the lower surface of the furniture body member 5, base plates 14 fixed horizontally to the lower ends of the holder plates 13, and a reinforcing plate 15 extending between and fixed to the front end portions of the lower surfaces of the base plates 14. The front edges of the base plates 14 are positioned in substantially the same plane as the front surface of the furniture body member 5, and the front edges of the holder plates 13 behind the mentioned plane.

Reference numeral 21 denotes laterally opposite sliders provided on the opposite surfaces of the holder plates 13. Each of these laterally opposite sliders 21 consists of a longitudinal fixed rail 22 fixed to the holder plate 13, and a longitudinal movable rail 23 supported on the longitudinal fixed rail so that the rail 23 can be moved in the longitudinal direction, that is, forward and rearward relative to the furniture body member 5. The longitudinal fixed rail 22 is formed in the shape of the letter "C" in its front elevation, and has at its front end portion a roller 24 which can be turned freely. The longitudinal movable rail 23 is formed in the shape of an inverted "L", and has at its rear end portion a roller 25 which can be turned freely. This roller 25 rollingly engages the upper flange of the longitudinal fixed rail 22, and the roller 24 provided on the fixed rail 22 engages the upper flange of the longitudinal movable rail 23, this movable rail 23 being then fitted slidably in the fixed rail 22, whereby the rail 23 can be longitudinally moved.

The two longitudinally movable rails 23, positioned at opposite sides of the lower portion of the furniture body member 5, are adapted to be moved synchronously by a lateral synchronizing means 31. This lateral synchronizing means 31 consists of a shaft mounting plate 32 extending between and fixed to the rear end portions of the upper surfaces of the base plates 14, a lateral synchronizing shaft 34 supported rotatably on shaft receivers 33 provided on the mounting plate 32, left and right synchronizing arm members 36 having lower end portions to which the shaft 34 is fixed, locking shafts 35 on the outer side surfaces of the upper end portions thereof, and guide plates 38 fixed to the rear end portions of the side surfaces of the longitudinally movable rails 23 and having at their upper portions recesses 37 with which the locking shafts 35 on the arm members 36 are engaged.

The movable rails 23 are provided at their front end portions with mounting members **23*a* bent at right angles thereto so as to extend toward each other, and a lateral slider 41 is movable on the front side of these mounting members 23*a*. This lateral slider 41 consists of a plate type lateral fixed rail 42 the upper and lower edge portions of which are curved in one direction, outer movable lateral rail 43 the upper and lower edge portions of which are curved in the other direction, and an inner movable lateral rail 44 provided between the rails 42, 43 and formed substantially to the shape of the letter "I" in side elevation thereof. Balls 45 are provided between the upper and lower edge portions of this inner movable lateral rail 44 and those of the lateral fixed rail 42 and outer movable lateral rail 43 so as to enable these rails 43, 44 to be moved slidingly in the lateral direction relatively to one another and the lateral fixed rail 42**.

The lateral fixed rail 42 is attached to the mounting members 23*a* of the longitudinally movable rails 23 via reinforcing plates 46 formed substantially to the shape of an inverted "L" in a side elevation thereof. The sliding movements of the rails 43, 44 in the lateral slider 41 are stopped when locking portions (not shown) formed on these rails engage one another. When the slider 41 is extended to the largest extent, the right end of the outer lateral movable rail 43 is positioned slightly to the left of the left end of the lateral fixed rail 42.

The front surface of the outer lateral movable rail 43 is provided at the right and left end portions thereof with plate type right and left roller holders 51, 52 fixed thereto, and at the portion thereof which is between these roller holders 51, 52 with a locking plate 54 fixed thereto and having a locking receiver 53 formed substantially to the shape of the letter "L" in side elevation.

Support rollers 55, 56 having longitudinal rotary shafts are provided on the front surfaces of the roller holders 51, 52 so that the rollers 55, 56 can be turned freely. The roller holders 51, 52 are provided with projections 51*a*, 52*a* formed substantially to the shape of an inverted "L" in a side elevation thereof and extending backward from the outer end portions of the upper edges of the roller holders 51, 52. The height and longitudinal length of the projection 51*a* on the right roller holder 51 are larger than those of the projection 52*a* on the left roller holder 52. The projection 51*a* on the right roller holder 51 is provided at its rear end portion with a first guide roller 57 mounted rotatably on a vertical rotary shaft, and the projection 52*a* on the left roller holder 52 is provided at its rear end portion with a second guide roller 58 mounted rotatably on a vertical rotary shaft.

A lateral fixed guide rail 61, which has mounting members 61*c*, 61*d* at both sides thereof, and which is formed substantially in the shape of the letter "C" in plan and in the shape of an inverted "L" in side elevation, is provided between the front portions of the holder plates 13 which are as high as the first guide roller 57. The lateral guide rail 61 is provided with a recess 61*a* in the left end portion thereof, i.e., in the portion thereof which is opposed to the second guide roller 58, and bent substantially in the shape of the letter "L" in plan at the right end portion thereof, i.e., at the portion thereof which is opposed to the first guide roller 57, to thereby form a housing 61*b*.

A substantially flat support rail 62 is fixed to the front end portions of the upper surfaces of the base plates 14, and the front edge portion of the support rail 62 is bent upward to form a projection 62*a*.

Reference numeral 66 denotes a connecting plate consisting of a horizontal plate portion 66*a* extending in a substantially horizontal direction, a front vertical plate portion 66*b* extending upward from the front edge of the horizontal plate portion 66*a*, and a rear vertical plate portion 66*c* extending downward from the rear edge of the horizontal plate portion 66*a* and serving also as a lateral guide rail. The front vertical plate portion 66*b* is fixed to the lower end portion of the rear surface of the door member 3 by bolts 67. The lower edge portion of the rear vertical plate portion 66*c* is engaged with the locking receiver 53 of the locking plate 54 provided on the lateral slider 41, so that the lower portion of the door member 3 is joined to the outer lateral movable rail 43 in the lateral slider 41. A cylindrical stopper 68 is provided on the right end portion of the upper surface of the horizontal plate portion 66*a* of the connecting plate 66.

This door device for furniture is provided with a synchronizing means 71 used to synchronize the movements of the lower and upper portions of the door member 3 while the door member 3 is slid in the longitudinal direction. This synchronizing means 71 will now be described.

The longitudinally movable rail 23 in the left longitudinal slider 21 is provided at its front portion with a locking member 72 fixed thereto and formed substantially to the shape of an inverted "L" in front elevation, and a laterally-extending elongated recess 72*a* is formed in an upper part of the locking member 72. A cylindrical locking portion 73*a* extending downward from the lower surface of one end portion of a lower arm member 73 is engaged slidably with this elongated recess 72*a*. A cylindrical shaft receiver 73*b* is provided vertically on the upper surface of the other end portion of the lower arm member 73. A hexagonal vertical synchronizing shaft 74 is nonrotatably fitted at the lower end portion thereof in a substantially hexagonal interior of the shaft receiver 73*b*.

Figure 4:
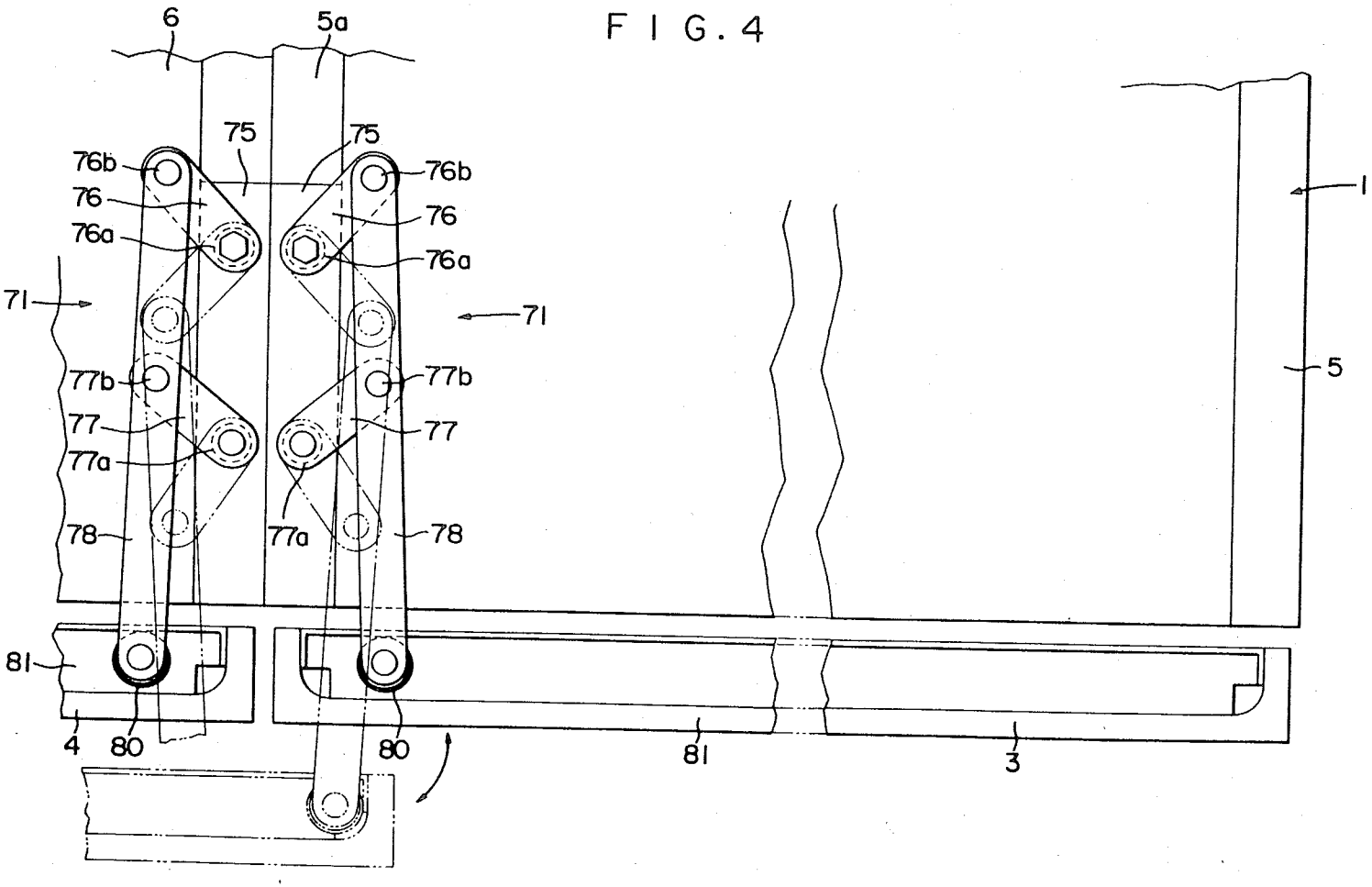
FIG. 4 is a partially cutaway view in plan of a mechanism for synchronizing the movements of the upper and lower portions of a door member.
Figure 5:
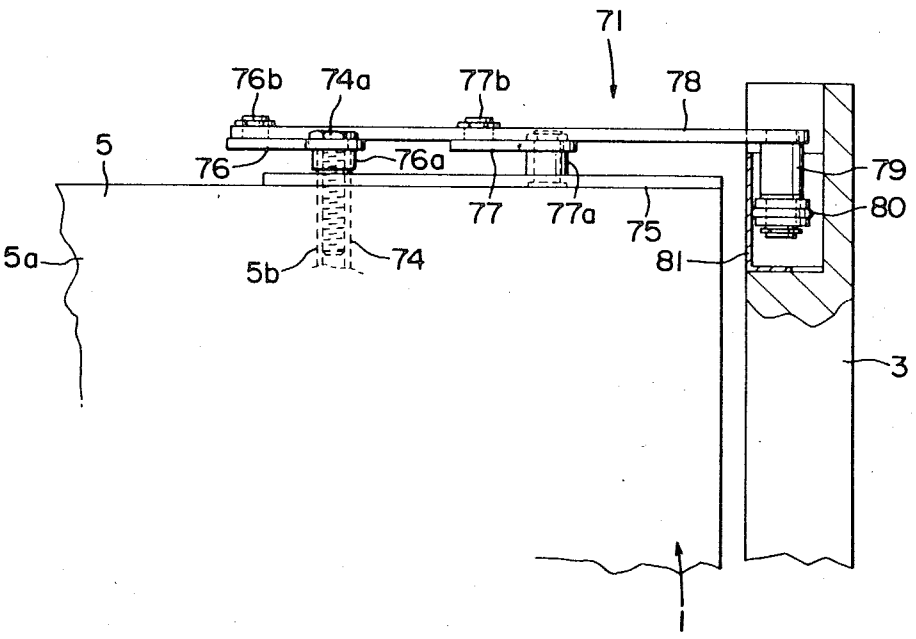
FIG. 5 is a partially cutaway view in side elevation of the mechanism of FIG. 4.

The vertical synchronizing shaft 74 extends freely rotatably through a through bore 5*b* which is formed vertically in a left side plate 5*a* of the furniture body member 5. A fixed plate 75 (FIGS. 4 and 5) is attached to and overlies the upper surface of the side plate 5*a* and defines the upper end portion of the through bore 5*b*. The fixed plate 75 supports on the rear and intermediate portions thereof cylindrical portions 76*a*, 77*a* which extend downward from the lower surface of one end portion of a rear upper arm member 76 and the lower surface of one end portion of a front upper arm member 77, in such a manner that these supported portions 76*a*, 77*a* can be turned freely. In the cylindrical interior, which has a substantially hexagonal cross section, of the supported portion 76*a* of the rear upper arm member 76, the upper end portion of the vertical synchronizing shaft 74, which projects up from the through bore 5*b*, is fitted fixedly by using a bolt 74*a*. The shaft portions 76*b*, 77*b* provided vertically on the upper surfaces of the other end portions of the upper arm members 76, 77 are joined pivotably to the rear portion of a longitudinally movable plate 78. The distance between these shaft portions 76*b*, 77*b*, i.e. the fulcrums on the longitudinally movable plate 78 is larger than that between the supported portions 76*a*, 77*a*, i.e. the fulcrums on the furniture body 1.

The longitudinally movable plate 78 is provided at the front end portion thereof with an upper support roller 80 having a vertical rotary shaft and joined to the front end portion of the mentioned plate 78 via a support member 79 so that the roller 80 can be rotated freely. The support roller 80 is slidably fitted in and supported on the inner side of a cross-sectionally J-shaped upper support rail buried in the upper edge portion of the door member 3.

The outline of a method of assembling the door device in this embodiment will now be described.

First, the frame 11 to which the longitudinal sliders 21, lateral slider 41 and lateral synchronizing means 31 are fixed is fitted into the lower portion of the furniture body member 5 from the front side thereof. Screws (not shown) are driven into the holder plates 13 on the frame 11 via the screen plates 12 extending downward from the edge portions of both sides of the lower surface of the furniture body member 5, to thereby fix this frame 11 to the furniture body member 5. The vertical synchronizing shaft 74 is then inserted through the through bore 5*b* in the side plate 5*a* of the furniture body member 5 to assemble the vertical synchronizing means 71. The upper support roller 80 in the vertical synchronizing means 71 is engaged with the upper support rail 81 on the door member 3, and the rear vertical plate portion 66*c* of the connecting plate 66 is fixed to the lower portion of the door member 3 with the locking receiver 53 of the locking plate 54 fixed to the front surface of the lateral slider 41 to fix the door member 3.

The door device can thus be combined easily with the furniture body member 5.

The operation of the door device in this embodiment will now be described.

To open the closed door member 3, it is slid forward first. When the door member 3 is pulled forward, the longitudinal movable rails 23 are slid forward with respect to the longitudinal fixed rails 22 in the longitudinal sliders 21, so that the door member 3 connected to the lateral slider 41, which is provided on the front side of these longitudinal movable rails 23, via the connecting plate 66 is moved forward.

While the longitudinal sliders 21 are operated in this manner, the rails 23 are moved smoothly owing to the rollers 24, 25 provided on the rails 22, 23.

The movements of the rails 23 positioned on both sides of the furniture body member 5 are synchronized by the lateral synchronizing means 31. Namely, the synchronizing of the movements of the rails 23 is done owing to the pivotal movements, the quantities of which correspond to those of movements of the longitudinal movable rails 23, of the arm members 36 engaged with the rails 23 and joined to each other fixedly by the shaft 34. It is, of course, necessary that the shaft 34 is not moved longitudinally with respect to the furniture body 1, and that the locking shafts 35 of the arm members 36, which are engaged with the recesses 37 in the guide plates 38 that are fixed to the longitudinal movable rails 23, are not moved longitudinally with respect to the longitudinally movable rails 23. Since the movements of the longitudinally movable rails 23 are synchronized in the above-mentioned manner, the door member 3 is not inclined laterally while the door member 3 is moved longitudinally. This enables the door member 3 to be moved stably.

While the door member 3 is slid forward, the guide rollers 57, 58 provided on the roller holders 51, 52 fixed to the front surface of the lateral slider 41 are moved slidingly along the holder plates 13 which serve also as longitudinal guide rails. Therefore, the lateral shaking of the door member 3 can be prevented, so that the door member 3 can be moved smoothly in the longitudinal direction.

As the longitudinally movable rails 23 are moved forward, the lower arm member 73 engaged with the locking plate 72 provided on one of the rails 23 is turned around the shaft receiver 73*b* thereof to cause the vertical synchronizing shaft 74, which is fixed to the shaft receiver 73*b*, to be turned. With the turning movement of the shaft 74, the rear upper arm member 76, which is fixed at its portion 76*a* to be supported by the shaft 74, is pivotally moved. Consequently, the longitudinally movable plate 78 connected to the rear upper arm member 76 is moved forward by a distance equal to the distance by which the rails 23 are moved. Since the movements of the lower and upper portions of the door member 3 are synchronized by such an operation of the vertical synchronizing means 71, the door member 3 is not inclined in the longitudinal direction.

When the door member 3 is in a forwardly-drawn state, the support rollers 55, 56 provided on the front side of the lateral slider 41 are spaced slightly above the fixed support rail 62. Accordingly, when the door member 3 is in this state as well as in a closed state, the load of the door member 3 is supported by the lateral slider 41, which is in a folded state, and by the upper support roller 80 of the vertical synchronizing means 71.

The door member 3 is then slid to the left by the lateral slider 41 to superpose the door member 3 over the front surface of the other door member 4 and thereby open the front opening of the furniture body member 5. By such sideward displacement of the door member 3 the inner lateral movable rail 44 and the outer lateral movable rail 43 with which the door member 3 is connected are moved slidingly with respect to the lateral fixed rail 42 attached to the longitudinal movable rails 23.

During this time, the first guide roller 57 provided on the right roller holder 51 fixed to the outer lateral movable rail 43 engages the front surface of the lateral guide rail 61 that is fixed to the frame 11, to thereby prevent the door member 3 from being moved in the backward direction. At the same time, the second guide roller 58 provided on the left roller holder 52 engages the front surface of the rear vertical plate portion 66*c* of the connecting plate 66 for the adjacent door member 4, which thus also serves a a lateral guide rail, to thereby prevent the door member 4 from being opened and the opened door member 3 from being moved in the backward direction.

The lateral slider 41 supporting the lower portion of the door member 3 is supported on only the longitudinally movable rails 23. These longitudinally movable rails 23 are supported on the longitudinal fixed rails 22 so that the movable rails 23 shake slightly. Therefore, when the door member 3 is slid sideward to a distance corresponding to about half of the width thereof, the extending lateral slider 41 is inclined slightly downward to the load of the door member 3, and the support roller 56 on the left side of the outer lateral movable rail 43 engages the support rail 62 that is fixed on the furniture body member 6. Namely, the moment it becomes undesirable that the load of the door member 3 be imposed upon the extended lateral slider 41, this load comes to be supported on the support roller 56.

Accordingly, the durability of the lateral slider 41 can be improved, and the door member 3 can be moved smoothly in the lateral direction.

Since the means for sliding the door member 3 in the lateral direction as mentioned above consists of the lateral fixed rail 42 attached to the longitudinal movable rails 23, and the lateral movable rails 43, 44 are supported slidably on this lateral fixed rail 42, it is not necessary to accurately restrict the quantity of lateral sliding movement of the door member 3. This enables the door device to be manufactured easily. Since the roller 56 supporting the load of the door member 3 engages the flat support rail 62 that is beneath the adjacent door member 4 after the lateral slider 41 has been extended to a certain extent, it is sufficient that the support rail 62 be formed to a length substantially equal to the width of the door member 4. Since the support roller 56, as it comes into juxtaposition with the support rail 62 that it will eventually engage, is spaced a little above that rail, the top surfaces of the respective support rails 62 for the two door members 3, 4 need not be absolutely coplanar, and the formation of the joint portions of the support rails 62 for the respective door members 3, 4 does not require so high an accuracy.

In addition, the door member 3 is confined to the desired sequence of movements by the guide rollers 57, 58 in their rolling engagement along the flat members 13, 61, 66*c* as mentioned above. Therefore, the parts of the door device do not require a very high dimensional accuracy, and can be assembled easily. Moreover, the door member 3 can be moved reliably and smoothly while it is in use.

The sideward movement of the door member 3 is stopped when the stopper 68 provided on the horizontal plate portion 66*a* of the connecting plate 66 engages the side edge of the connecting plate 66 for the adjacent door member 4.

As mentioned previously, the longitudinally movable plate 78 that carries the upper support roller 80 in the vertical synchronizing means 71 is moved laterally to a small extent in accordance with the longitudinal movements of the door members 3, 4 owing to swinging the upper arm members 76, 77 to render the plate 78 longitudinally movable. Moreover, the distance between the shaft portions 76*b*, 77*b* of the resective upper arm members 76, 77, which are connected pivotably to the longitudinal movable plate 78, is longer than that between the supported portions 76*a*, 77*a* which are connected pivotably to the fixed plate 75. Therefore, when the door member 3 is displaced rearward as shown by solid lines in FIG. 4, the longitudinal movable plate 78 is inclined in the forward rightward direction, and, when the door member 3 is pulled forward, the longitudinal movable plate 78 is inclined in the forward leftward direction. Namely, when the door member 3 is closed, the upper support roller 80 provided on the longitudinal movable plate 78 is positioned in the portion of the inside of the upper support rail 81 on the door member 3 which is closer to the intermediate portion thereof. Accordingly, this door member 3 is supported stably. When the door member 3 is opened, the upper support roller 80 is positioned nearer to the other door member 4, so that the door member 3 can be opened to a greater extent.

In order to close the door member 3 after it has been opened, it is slid to the right and then rearward.

In the above embodiment, the holder plate 13 comprises of the longitudinal guide rail on which the first guide roller 57 is moved slidingly while the door member 3 is moved longitudinally. It may also consist of a longitudinal guide rail with the first guide roller 57 sliding on the side surface of the housing portion 61*b* of the lateral guide rail 61. The mounting member 61*d* of the lateral guide rail 61 may also comprise a longitudinal guide rail on which the second guide roller 58 slides.

In the above-described embodiment, the front opening 2 of the furniture body 1 is opened and closed by and with a pair of door members 3, 4. However, the present invention is not limited to a door device having two door members 3, 4. As many as three door members may be provided in the front opening 2.

What is claimed is:

1. In a furniture body that has a pair of opposite sides which are spaced apart laterally, a rear, and an open front at which there are a pair of laterally extending zones, each of which has one end adjacent to the other zone and an opposite end spaced laterally from said other zone, said furniture body having a pair of doors, one for each of said zones, which cooperate to close said front when each is in a closed position wherein it extends edgewise laterally across its zone and has a front surface substantially coplanar with a front surface of the other door, a device for guidingly controlling movement of each said door between its closed position and an open position wherein the door is superposed in front of the other door, said device comprising, for each door:

A. stationary structure fixed on said furniture body near the front thereof and in said zone for the door, said stationary structure comprising
  (1) a pair of elongated fore-and-aft extending rail members, each having a front end and a rear end, one of said rail members being near said one end of said zone and the other being near said opposite end thereof,
  (2) a supporting rail having an upwardly facing elongated surface that extends laterally substantially the entire distance between said ends of said zone, and
  (3) a guide rail having a forwardly facing elongated surface which extends laterally substantially from said one end of said zone to a point which is spaced from said opposite end thereof and is adjacent to the front end of said other rail member;

B. carrier structure movable for translating the door flatwise forward to a defined laterally extending door shifting path and rearward to its closed position, comprising
  (1) a pair of elongated carrier elements, one for each of said rail members, each substantially confined by its rail member to forward and rearward motion, and
  (2) a laterally elongated slider guide member having opposite end portions which are fixed to said carrier elements;

C. means for guiding the door for motion edgewise along said door-shifting path between the zone for the door and its open position, said means comprising
  (1) a plurality of elongated laterally extending slider elements, each having a leading end adjacent to the zone for the other door and an opposite trailing end, said slider elements being confined by cooperation with one another and with said slider guide member to lengthwise sliding motion relative to the slider guide member whereby an outer one of said slider elements is carried between
    (a) a retracted position wherein said one slider element is wholly within said zone for the door and
    (b) an extended position wherein it is substantially wholly within the zone for the other door, and
  (2) means on said outer one of the slider elements for fixing the door thereto;

D. a supporting roller on said outer one of the slider elements, near said leading end thereof, rotatable on a substantially fore-and-aft extending axis and positioned to be spaced a small distance above said surface on said supporting rail but to be engaged under the weight of the door against the supporting rail of the device for the other door when said outer one of the slider elements is in its extended position;

E. an arm fixed to and projecting rearward from the trailing end portion of said outer one of the slider elements; and F. a guide roller on said arm, rotatable on a substantially vertical axis and arranged (1) to guidingly engage said other rail member during movement of the carrier structure and (2) to guidingly engage said forwardly facing surface on the guide rail during motion of said outer one of the slider elements between its retracted and extended positions, to confine the door to edgewise motion along said path.

2. The device of claim 1, further characterized by:

(1) a laterally extending shaft confined to rotation in opposite directions in relation to said furniture body and having an end portion adjacent to each of said rail members;

(2) an arm fixed on each of said end portions of the shaft, each said arm having a free end portion which swings substantially forward with rotation of the shaft in one of said opposite directions and substantially rearward with rotation of the shaft in the other of those directions; and (3) means connecting said free end portion of each of said arms with its adjacent one of said carrier elements to constrain the carrier element and said free end portion of the arm to backward and forward motion in unison so that movements of the carrier elements are synchronized through the shaft.

3. The device of claim 1 wherein the door has an upwardly opening groove extending along an upper end thereof, further characterized by:

(1) a vertically extending shaft in said furniture body, near said one end of said zone, confined to rotation relative to the furniture body;

(2) an actuating arm having one end fixed to a lower end portion of said vertically extending shaft and having an opposite end swingable forwardly and rearwardly for imparting rotation in opposite directions to the shaft;

(3) means providing a motion transmitting connection between said opposite end of the actuating arm and the carrier element for said one rail member whereby forward and rearward motion of that carrier element imparts forward and rearward swinging to said actuating arm;

(4) a link arm having one end fixed to an upper end portion of said shaft and having an opposite end swingable forwardly and rearwardly in unison with forward and rearward swinging of said actuating arm;

(5) an elongated substantially fore-and-aft extending guide arm (a) having a front end to which is attached a roller that is guidingly confined in said groove in the door and (b) having a pivotal connection with said opposite end of the link arm that is spaced along the length of the guide arm from its said front end; and (6) arm confining means on the furniture body, engaging a portion of said guide arm that is spaced along its length from its front end and from said pivotal connection, for constraining the guide arm to move substantially lengthwise forwardly and rearwardly with forward and rearward swinging of said link arm.

4. The device of claim 3, further characterized in that said arm confining means comprises:

a control link having opposite ends and (a) having at one of said ends a pivotal connection with said guide arm that is spaced along the latter from its front end and from its said pivotal connection with the link arm, and (b) having at its other end a connection with the furniture body that provides for swinging of its said one end about an axis which is parallel to and spaced a distance from the axis of said vertically extending shaft and which intersects a fore-and-aft extending line that also intersects the axis of that shaft.

5. The device of claim 4 wherein said link arm and said control link project substantially in the lateral direction towards said other side of sadi zone from said axes, and wherein said distance is smaller than the distance between the axes of said pivotal connections to the guide arm so that the guide arm moves forward with a component of lateral motion towards the other zone.

* * * * *